US007013885B2

(12) United States Patent
Czajkoski

(10) Patent No.: US 7,013,885 B2
(45) Date of Patent: Mar. 21, 2006

(54) COLLAPSIBLE GRILL AND STAND

(75) Inventor: William A. Czajkoski, 19500 W. Bauer Rd., Custer Park, IL (US) 60481

(73) Assignee: William A. Czajkoski, Custer Park, IL (US)

( * ) Notice: Subject to any disclaimer, the term of this patent is extended or adjusted under 35 U.S.C. 154(b) by 0 days.

(21) Appl. No.: 10/613,312

(22) Filed: Jul. 7, 2003

(65) Prior Publication Data

US 2005/0005926 A1 Jan. 13, 2005

(51) Int. Cl.
*F24B 3/00* (2006.01)
*A47J 37/07* (2006.01)

(52) U.S. Cl. ..... 126/30; 126/9 R

(58) Field of Classification Search ..... 126/29, 126/30, 25 R, 25 A, 9 R; 248/188.7, 165, 248/121

See application file for complete search history.

(56) References Cited

U.S. PATENT DOCUMENTS 4,065,085 A * 12/1977 Gellatly ..... 126/30
4,117,825 A * 10/1978 Robertson ..... 126/29
4,538,589 A * 9/1985 Preston ..... 126/30
4,553,525 A * 11/1985 Ruble ..... 126/30
4,896,651 A * 1/1990 Kott, Jr. ..... 126/30
4,979,490 A * 12/1990 Nudo et al. ..... 126/30
5,287,844 A * 2/1994 Fieber ..... 126/30
5,944,009 A * 8/1999 Scheller ..... 126/30

* cited by examiner

*Primary Examiner*—Josiah C. Cocks
(74) *Attorney, Agent, or Firm*—Wallenstein Wagner & Rockey, Ltd.

(57) ABSTRACT

A collapsible grill and stand which can be used indoors over a fireplace, having a grill stand which makes it possible to position and support the grill member over the burning logs, charcoal or gas within the fireplace and under the flue so the smoke, gases, odors and heat are exhausted to the outside through the flue and do not enter the interior of the room or building. The stand includes an upright center post having a vertical passageway in which a telescoping insert is received, such insert having a laterally extending arm, at the outer end of which the grill member is secured. Three support legs extend laterally from the lower end of the upright post, two of which are pivotable to enable positioning the legs in a radially spread apart configuration that will support the grill member at the outer end of the laterally extending arm over the fire in a fireplace. A vertical height adjusting mechanism is provided to adjust the height of the grill member over the fire. The laterally extending arm is rotatable through a limited arcuate path. A rotation limiting assembly is provided to limit the rotation of the laterally extending arm and grill member on its outer end to prevent the grill and stand from becoming unbalanced and tipping over.

2 Claims, 5 Drawing Sheets

COLLAPSIBLE GRILL AND STAND

FIELD OF THE INVENTION

This invention relates to the field of grills, and stands for grills, which burn combustible materials such as charcoal and the like, and particularly to those which can be folded or collapsed into a compact unit for purposes of storage, portability and the like. Furthermore the invention relates to grills which can be used indoors over a fireplace, having a grill stand which makes it possible to position and support the grill member over the burning logs, charcoal or gas within the fireplace and under the flue so the smoke, gases, odors and heat are exhausted to the outside through the flue and do not enter the interior of the room or building.

BACKGROUND OF THE INVENTION

Charcoal grills and those which use other combustible material that are known to the prior art cannot be used indoors because the smoke, gases, odors and heat would be trapped in the room and would create a fire hazard. The collapsible grill and stand in accordance with this invention solves that problem. Some prior art grills and stands are partially collapsible or foldable, or can be partially disassembled into a more compact unit for purposes of storage or transport and the like. However, those known to the prior art require a relatively large fire pot or bowl in which to place and burn the charcoal, and such pot or bowl is a unitary structure which cannot be collapsed or folded into a smaller more compact unit. Thus, even when prior art grills can be partially collapsed or folded, the relatively large fire pot or bowl still remains as the largest most bulky component making such grills still hard to store and transport. They still require a relatively large space or compartment for storage and are still cumbersome to carry or otherwise transport. The collapsible grill and stand in accordance with this invention solves that problem since it does not require a fire pot or bowl at all. The grill stand has been constructed in such a way that it can position and support the flat grill member itself outwardly from the stand and over an indoor fireplace, or over a campfire on the ground when used outdoors.

SUMMARY OF THE INVENTION

The grill and stand in accordance with this invention includes an upright center post with a central bore, a grill supporting member that comprises a telescoping shaft received in the central bore having a support arm extending laterally from the telescoping shaft, a height adjusting mechanism to raise and lower the telescoping shaft, a spindle extending upright at the outer end of the laterally extending support arm to receive the hub of the flat grill member itself thereon to support the grill member for use over the fire in a fireplace or over a campground fire, and three laterally extending support legs projecting outwardly from the lower end of the upright center post, each of such legs being rotatable or radially pivotable around the axis of the center post to any selected radial and spaced apart position that will support the grill member at its location at the outer end of the laterally extending support arm over a fireplace or camp fire. For example, the support legs can be rotated to form a Y-shaped configuration with two of the support legs forming the diverging fork portion of the Y which are placed facing the fireplace or campground fire and the third support leg rotated to form the leg of the Y that extends away from the fireplace or campground fire. That radial positioning of the support legs will support the grill at the outer end of the laterally extending support arm and prevent it from tipping over, even though none of the support legs are positioned below the grill member itself where the fire is burning.

DESCRIPTION OF PREFERRED EMBODIMENT

Figure 1:
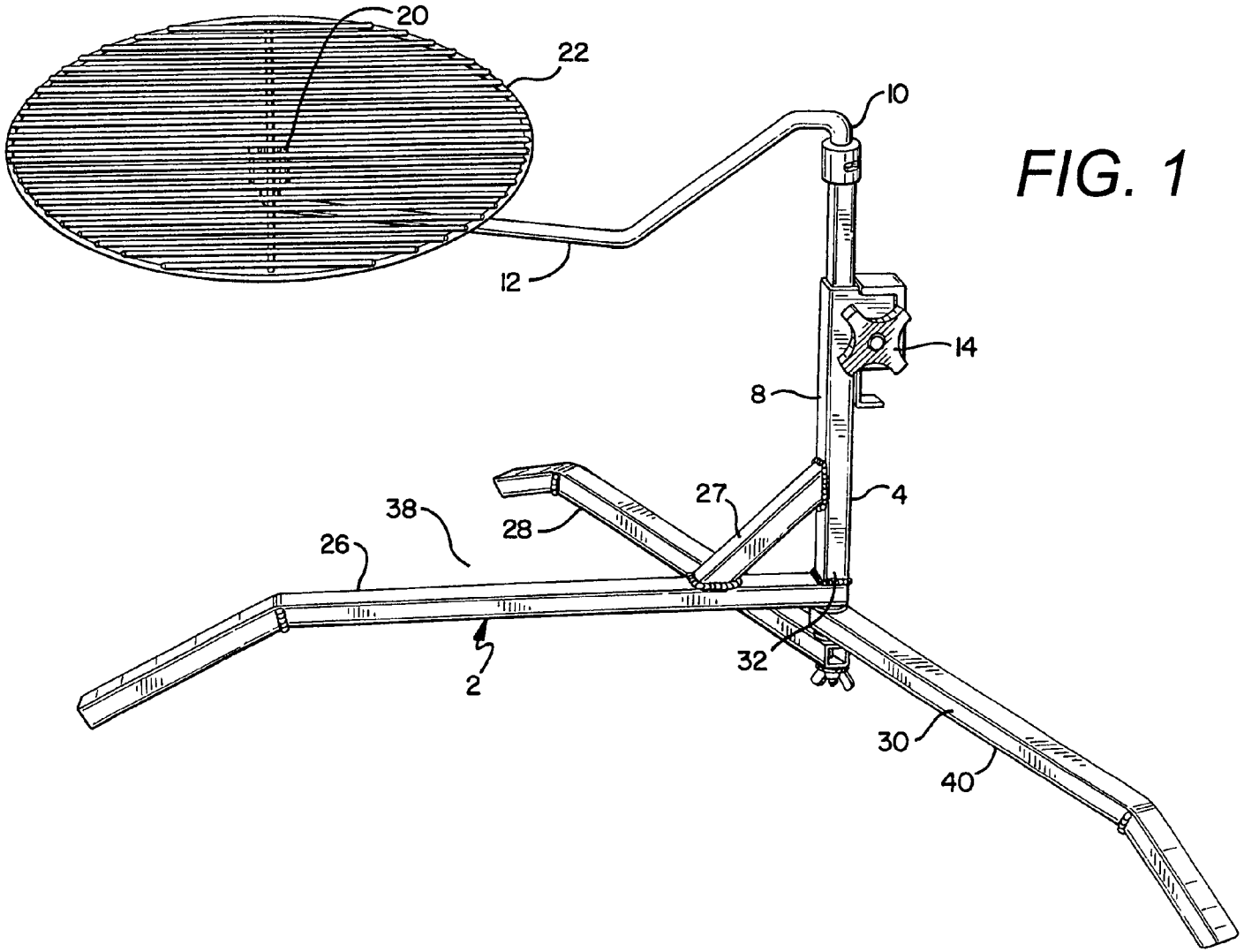
FIG. 1 is a perspective view of a collapsible grill and stand in accordance with this invention.
Figure 2:
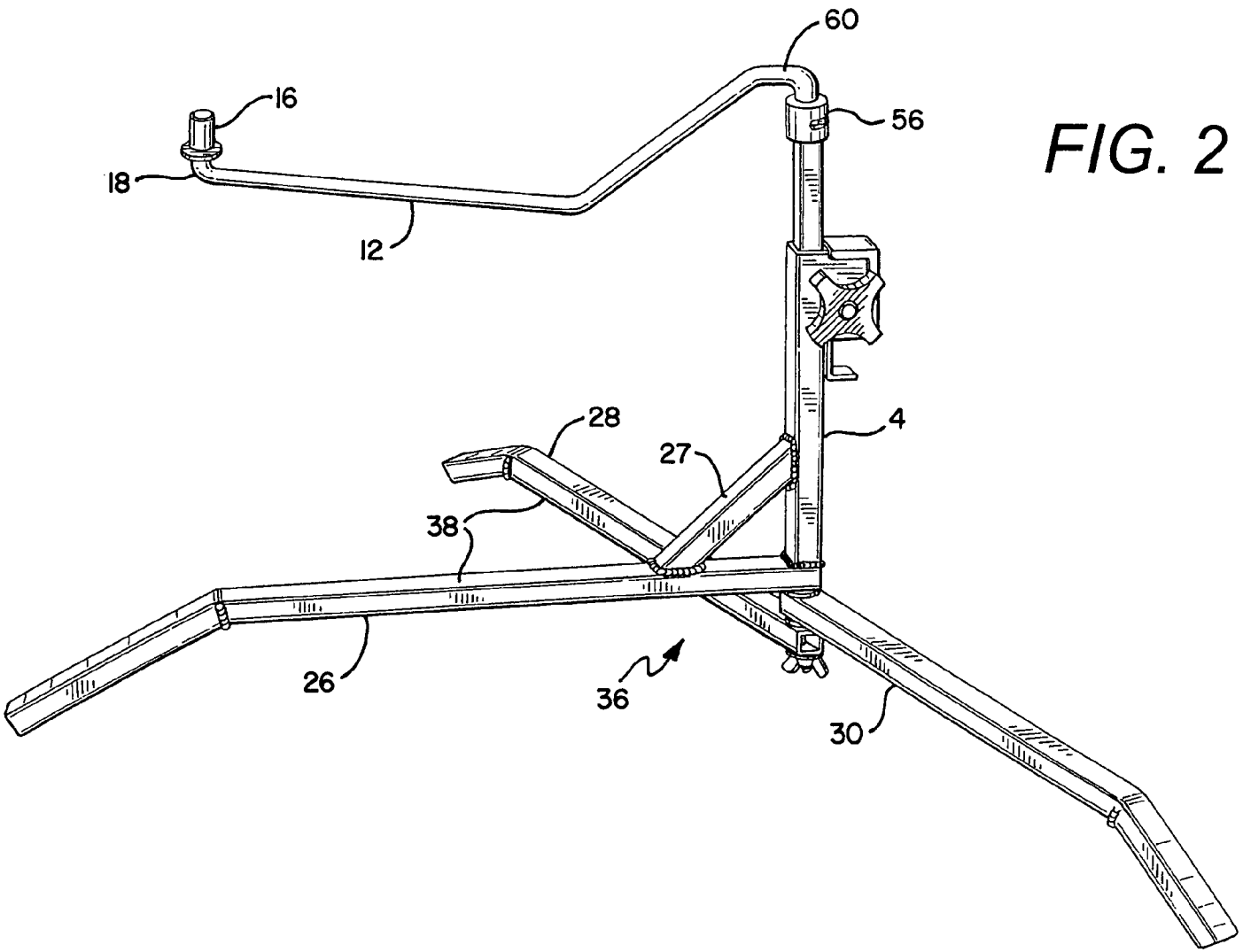
FIG. 2 is a perspective view of a collapsible grill and stand as shown in FIG. 1 but with the grill member removed to better illustrate parts not seen as clearly in FIG. 1.
Figure 3:
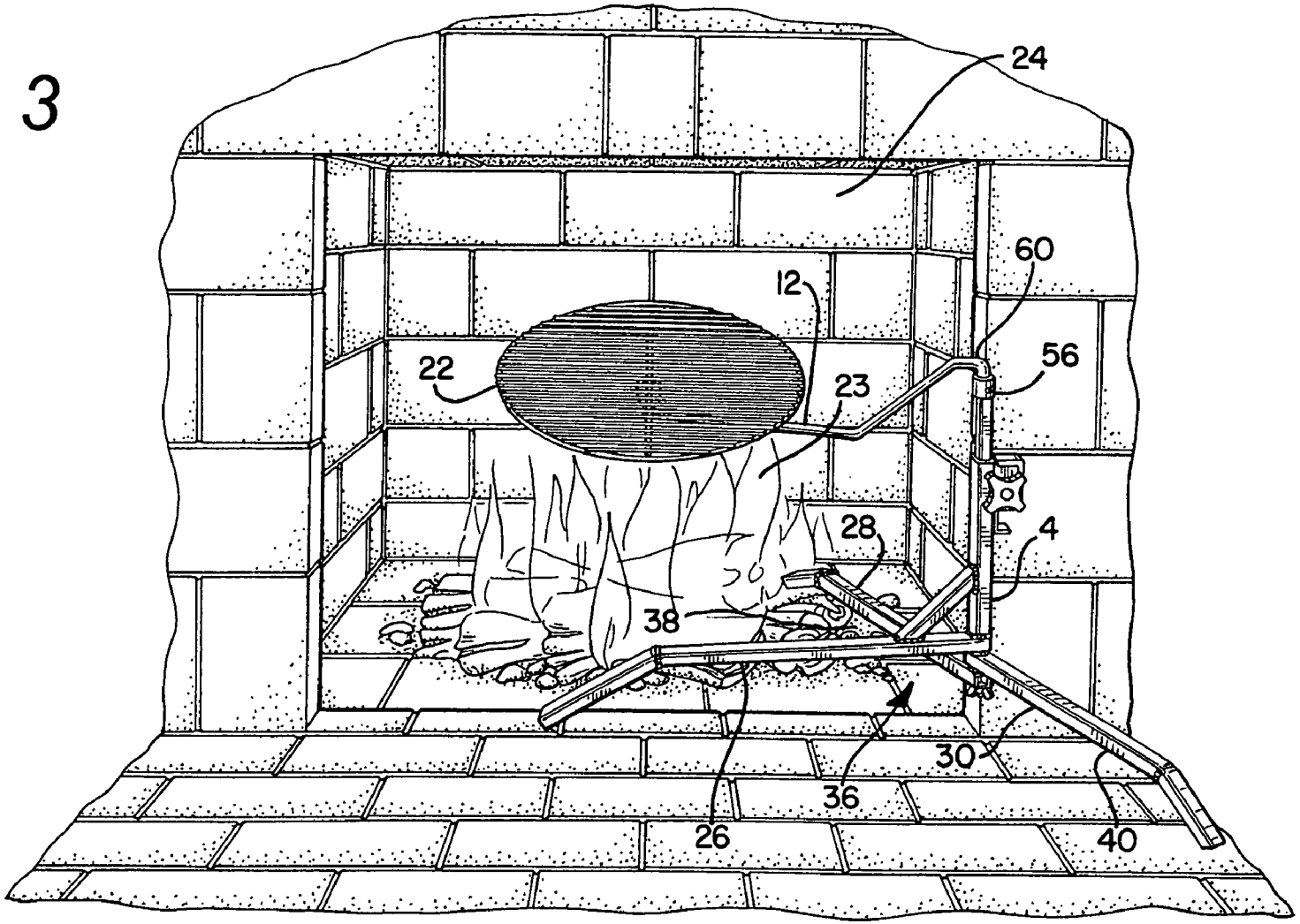
FIG. 3 is a perspective view of a collapsible grill and stand in accordance with this invention shown in place over a fire in a fireplace.
Figure 4:
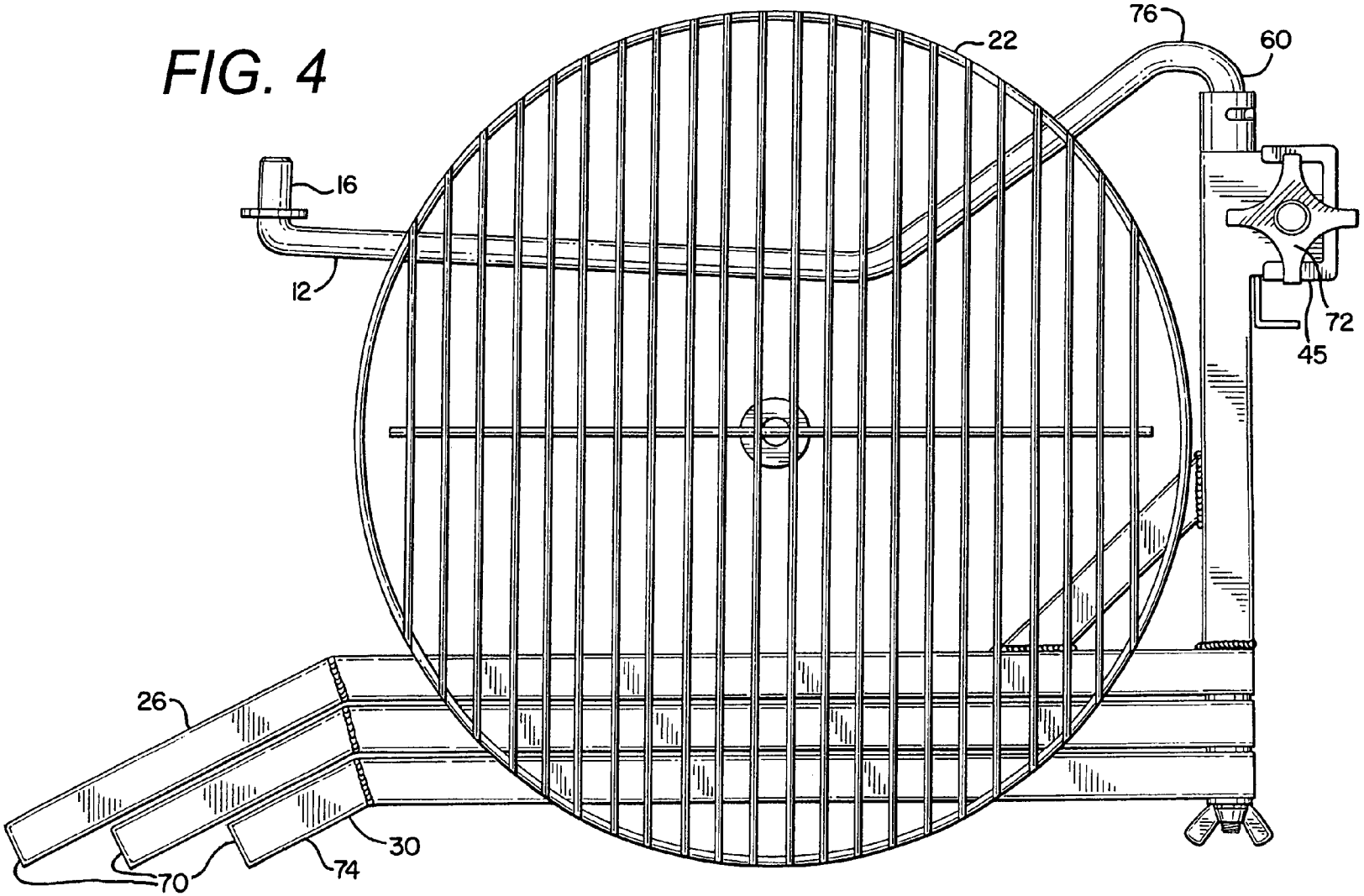
FIG. 4 is a plan view showing a collapsed grill and stand in accordance with this invention with a first ruler along the longitudinal side of the collapsed grill and stand to show the longitudinal measurement when collapsed as twenty-two inches, and with a second ruler along the lateral side of the collapsed grill and stand to show the lateral measurement when collapsed as thirteen and a half inches.
Figure 6:
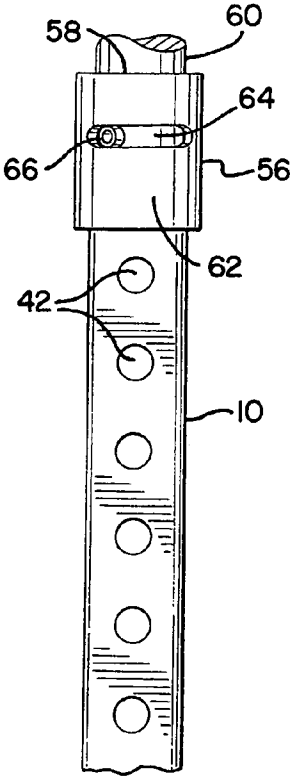
FIG. 6 is an elevation view of the side of the telescoping insert that has the height adjusting apertures therein.
Figure 5:
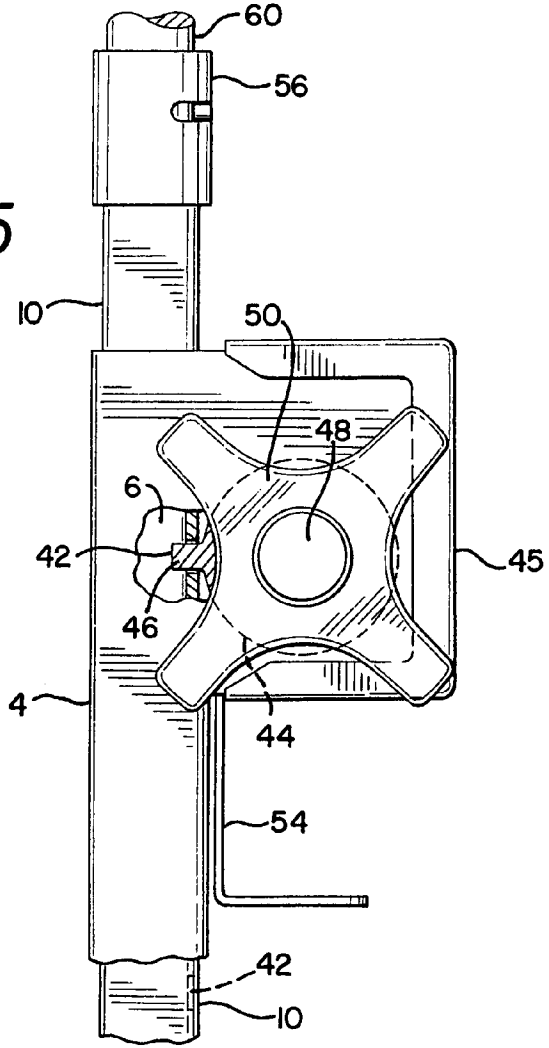
FIG. 5 is a side elevation view of a portion of the upright center post, a portion of the telescoping insert therein, a portion of the shaft which extends out from the bore of the rotation limiting collar with its rotation limiting slot, the vertical height adjusting component in which a portion of the rotatable carrier for the lifting lugs is shown in broken lines to show it is inside of the housing on the rotatable shaft rotated by the knob seen on the exterior of the housing, a portion of the upright center post being broken away to illustrate one of the lifting lugs of the rotatable carrier inserted into one of the apertures of the telescoping insert.

A collapsible grill and stand 2 in accordance with the present invention comprises an upright center post 4 with a central passageway 6, a grill supporting assembly 8 that comprises a telescoping insert 10 received in the central passageway 6 of the upright center post 4, the grill supporting assembly 8 having a support arm 12 extending laterally from the telescoping insert 10, a height adjusting mechanism 14 to raise and lower the telescoping insert 10 and support arm 12, a spindle 16 extending upright at the outer end 18 of the laterally extending support arm 12 to receive the hub 20 of the flat grill member 22 thereon to support the grill member 22 for use over the fire 23 in a fireplace 24 or over a campground fire, and three laterally extending support legs 26, 28 and 30 projecting outwardly from the lower end 32 of the upright center post 4. One of the support legs 26 is rigidly affixed to the lower end of the center post 4 and extends laterally outward therefrom. A diagonal support brace 27 extends from the center post 4 to the support leg 26. The other support legs 28 and 30 are rotatable or radially pivotable around the axis of the center post to any selected radial and spaced apart position that will support the grill member 22 at its location at the outer end of the laterally extending support arm over a fireplace or campfire. For example, the support legs can be rotated to form a Y-shaped configuration 36 with two of the support legs 26 and 28 forming the diverging fork portion 38 of the Y which are placed facing the fireplace or campground fire and the third support leg 30 rotated to form the leg 40 of the Y that extends away from the fireplace or campground fire. That radial positioning of the support legs will support the grill 22 at the outer end of the laterally extending support arm 12 and prevent it from tipping over. None of the support legs have to be positioned below the grill member itself where the fire is burning to prevent the grill member 22 from tipping. The support leg 30 need not extend directly away from the fork portion 38 formed by the support legs 26 and 28 to form a Y configuration, but support leg 30 can be rotated to any radial position away from the fork portion 38 that will stabilize the grill and stand 2.

The height adjusting mechanism 14 comprises a plurality of vertically spaced apart apertures 42 in the telescoping insert 10 and a rotatable carrier member 44 in the housing 45 adjacent the center post 4. The carrier member 44 has a plurality of lugs 46 carried thereon for insertion of respective ones of such lugs in respective ones of the apertures 42 that face one of such lugs 46 as the rotatable shaft 48 on which carrier member 44 is mounted is rotated in the direction that causes the inserted lug 46 to move upwardly. The upright telescoping insert 10 is moved upwardly as the inserted lug 46 in an aperture 42 is rotated to move upwardly and arcuately. As it moves in an arcuate path when the carrier member 44 is rotated, the inserted lug 46 is moved not only upward but also away from the telescoping insert 10 and thus withdrawn outwardly from the aperture 42. At the same time, the next following lug 46 comes into registration with the next following aperture 42 in the insert 10. That next following lug 46 is then inserted in that next following aperture 42 to continue moving the telescoping insert 10 upward. The process is repeated until the desired height of the insert 10 and grill member 22 has been reached. A knob 50 is provided to rotate the shaft 48.

The lugs 46 are mounted on the rotatable carrier member 44 to project outwardly therefrom for insertion into the respective apertures 42 of the telescoping insert 10. The carrier member 44 is rotated in the direction of rotation that moves the lugs 46 and telescoping insert 10 upwardly.

In order to move the telescoping insert 10 downwardly from an adjusted upward position, a slide member 54 is provided to slide upwardly through slots in the housing 45. The upper end of the slide member 54 comes into contact with the lug 46 that is inserted into one of the apertures 42 of the center post 4. As the slide member 54 is moved further upwardly, it dislodges the lug 46 from such aperture 42. While the slide member 54 is in such moved upward position, it blocks any of the lugs 46 from insertion into apertures of the telescoping insert 10 so it can then be pushed downwardly to another selected vertical position after which the slide member 54 may be moved downwardly out of blocking contact with the lugs 46. One of the lugs 46 can then enter the facing aperture 42 of the telescoping insert 10 to hold it at such newly selected vertical position.

A rotation-limiting collar 56 is rigidly mounted at the upper end of the telescoping insert 10, having a bore 58 in registration with the passageway of the telescoping insert 10 for reception therethrough of the shaft 60 of the grill supporting assembly 8. The collar 56 comprises an annular wall 62 having a rotation limiting slot 64 therethrough, that extends in an arcuate path for a limited distance of about seven-eighths of an inch. A rotation-limiting lug 66 is affixed to the shaft 60 of the grill supporting assembly and is received in the rotation-limiting slot 62. The shaft 60 and the grill support arm 12 which extends laterally from the shaft 60 can therefore rotate only a limited distance between the positions where the limiting lug 66 abuts against each opposite end of the rotation limiting slot 64. When in use, the center post 4, telescoping insert 10 and shaft 60 are positioned so that the rotation limiting slot 64 in its rotation limiting collar 56 faces in the direction opposite from the direction toward the fire 23 in the fireplace 24 or campground fire. Thus, when the grill support arm 12 positions the grill member 22 over the fire, the grill support arm 12 and the shaft 60 from which it extends can only be rotated in a limited arcuate direction between a first position directly over the fire 23 and a second position away from the fire 23 for access to the food cooking thereon. This rotation-limiting feature prevents rotating the grill member 22 and the food thereon so far that the grill and stand may begin to tip.

When the grill and stand are collapsed, the laterally extending support legs 26, 28 and 30 lie adjacent to one another in one above the other relationship extending laterally from the upright center post 4. The housing 45 of the vertical height adjusting mechanism extends laterally from the upright center post 4 in the opposite direction. The outer ends of the support legs define the outermost point 70 of the collapsed grill and stand at one side thereof and the outermost boundary of the housing 45 defines the outermost point 72 of the collapsed grill and stand at the opposite side thereof. The distance between the points 70 and 72 is twenty-two inches. The outermost ends of the support legs 28, 29 and 30 define the outermost point 74 of the collapsed grill and stand at the lower end thereof, and the top portion of the shaft 60 and its integrally formed laterally extending arm 12 define the outermost point 76 of the collapsed grill and stand at the upper end thereof. The distance between the points 74 and 76 is thirteen and a half inches. The grill member 22 when laid on top of the collapsed or folded support legs and laterally extending arm 12 is within those boundary dimensions. Thus, the rectangular dimension of the grill and stand 2 when collapsed is twenty-two inches by thirteen and a half inches.

The depth of the grill and stand 2 when collapsed from the lowermost support legs to the uppermost grill member 22 laid thereon and adjusting knob 50 is one and three-fourths inches. Thus, the three dimensions of the grill and stand 2 when collapsed is one and three-fourths inches in depth, twenty-two inches in length and thirteen and a half inches in width. The collapsed grill and stand 2 in accordance with this invention can be stored in its entirety in a compartment or space of those relatively small dimensions. That is smaller than the space needed to store any cooking grill and stand known to the prior art.

I claim:

1. A collapsible grill and stand, comprising:

a rotatable grill member supported by a stand above a heating location to be occupied by a separate cooking source below the rotatable grill member, the rotatable grill member comprising a central hub;

an elongated connecting member having an outer free end and an opposite connected end connecting the elongated connecting member to the stand;

an upwardly projecting pivot post adjacent the free end, the free end being receivable in the central hub of the rotatable grill member for rotation of the rotatable grill member around the pivot post, wherein the rotatable grill member is manually liftable from the pivot post and from the elongated connecting member, the rotatable grill member being completely and freely rotatable on the pivot post to position food items thereon at different locations relative to the cooking source below, wherein all parts of the stand are spaced apart laterally from the heating location, the stand including upwardly and laterally extending support members, the laterally extending support members having a downwardly facing lower surface for contact with a floor or other supporting surface on which the stand is placed, wherein all parts of the stand and the grill are above the downwardly facing lower surface whereby no part thereof penetrates into the floor or other supporting surface on which the stand is placed, wherein the support members of the stand are comprised of an upright post having a longitudinal passageway therein, a telescoping insert of the connecting member being received in the longitudinal passageway, the connecting member having an arm extending laterally from the telescoping insert and terminating at the outer free end, the rotatable grill member being supported at the outer end of the laterally extending arm, the telescoping insert of the connecting member pivotally mounted to pivot about the upright post, including a rotation limiting assembly to limit the amount of rotation of the pivotally mounted telescoping arm on the upright post, wherein the rotation limiting assembly comprises a rotatable shaft extending through the telescoping insert of the connecting member, the arm of the connecting member extending laterally from the upright post being integrally formed with the rotatable shaft, an annular collar on the rotatable shaft, an arcuate slot through the collar extending for a limited arcuate distance, a lug on the rotatable shaft received in the arcuate slot to limit rotation of the rotatable shaft and the arm extending laterally therefrom to the distance the lug is able to rotate between the opposite ends of the arcuate slot.

2. The collapsible grill and stand as set forth in claim 1, wherein the rotation limiting assembly permits the outer end of the arm of the connecting member extending laterally from the upright post to be arcuately movable between a position over the heating location to be occupied by a separate cooking source and a position away from the location for access to the food being cooked on the grill.

* * * * *